US006055946A

United States Patent [19]

Dombek et al.

[11] Patent Number: 6,055,946

[45] Date of Patent: May 2, 2000

[54] CRANKSHAFT-MOUNTED COOLING FAN WITH POWER TAKEOFF CAPABILITY

[75] Inventors: Bruce B. Dombek, Roselle; Ho Chul Song, Chicago, both of Ill.

[73] Assignee: Navistar International Transportation Corp, Chicago, Ill.

[21] Appl. No.: 09/365,966

[22] Filed: Aug. 2, 1999

[51] Int. Cl.[7] ..... F01P 7/10

[52] U.S. Cl. ..... 123/41.11; 123/41.49

[58] Field of Search ..... 123/41.11, 41.12, 123/41.47, 41.49

[56] References Cited

U.S. PATENT DOCUMENTS

| | | | |
|---|---|---|---|
| Re. 33,978 | 6/1992 | Shirai . | |
| 2,830,471 | 4/1958 | Steiner | 74/762 |
| 3,502,056 | 3/1970 | Dillard | 123/41.12 |
| 3,596,524 | 8/1971 | Cook | 74/15.4 |
| 3,613,645 | 10/1971 | Froumajou . | |
| 4,074,663 | 2/1978 | Cory . | |
| 4,257,370 | 3/1981 | Kasting . | |
| 4,321,896 | 3/1982 | Kasting . | |
| 4,372,409 | 2/1983 | Mazur . | |
| 4,672,922 | 6/1987 | Shirai . | |
| 4,763,744 | 8/1988 | McVicar et al. . | |
| 4,825,970 | 5/1989 | McVicar et al. . | |
| 4,862,755 | 9/1989 | Eastman et al. . | |
| 4,862,981 | 9/1989 | Fujikawa et al. . | |
| 4,890,583 | 1/1990 | Ohno et al. . | |
| 5,224,446 | 7/1993 | Okita et al. | 123/41.12 |
| 5,247,845 | 9/1993 | Grayson . | |
| 5,415,134 | 5/1995 | Stewart, Jr. | 123/41.01 |
| 5,529,028 | 6/1996 | Weikert . | |
| 5,588,325 | 12/1996 | Green et al. . | |

*Primary Examiner*—Willis R. Wolfe
*Assistant Examiner*—Katrina Harris
*Attorney, Agent, or Firm*—Dennis Kelly Sullivan; Jeffrey P. Calfa; Richard K. Clark

[57] ABSTRACT

A crankshaft-mounted cooling fan is described for an internal combustion engine. The cooling fan has an adapter (104) mounted on the engine's crankshaft (102). The adapter (104) is capable of being coupled to a power takeoff device (164). First and second adapter bearings (170, 172) are operatively connected to the adapter (104) and to a planetary gear assembly (141). The planetary gear assembly (141) is operatively connected to a fan housing (110), which connects to the engine. A clutch assembly (136) is attached to the adapter (104) in a position where it may engage the planetary gear housing (141). A solenoid (132) is connected to the fan housing (110) and is disposed for activating the clutch assembly (136). A fan blade set (174) is coupled to the planet gear assembly (141), which enables the fan blade set (174) to rotate at a faster speed than the engine. The clutch assembly (13) may be engaged or disengaged depending on the operating parameters of the engine or a motor vehicle.

29 Claims, 3 Drawing Sheets

CRANKSHAFT-MOUNTED COOLING FAN WITH POWER TAKEOFF CAPABILITY

FIELD OF THE INVENTION

The present invention relates generally to cooling fans for engines. More particularly, the present invention relates to cooling fans mounted on the crankshaft of an internal combustion engine.

BACKGROUND OF THE INVENTION

Better fuel economy and enhanced safety are benefits from lower hood lines on trucks and other motor vehicles. A lower hood line improves a truck's aerodynamics, thus reducing fuel consumption. A lower hood line also improves the line of site of the driver, thus providing for safer operation of the truck or motor vehicle.

One obstacle to lowering the hood line is the position of the cooling fan on the engine. The cooling fan is mounted above the crankshaft in many configurations. The crankshaft powers the fan to cool the engine through pulleys and a fan belt.

In contrast, a crankshaft-mounted cooling fan enables the hood line of a truck or motor vehicle to be lowered. It eliminates the need for pulleys and a fan belt to drive the fan. Consequently, there is more space in the engine cavity for auxiliary equipment. Alternatively, the engine cavity may be reduced. In addition, an engine is more reliable without a fan belt.

Even with these benefits, typical crankshaft-mounted cooling fans have adverse effects on engine performance and operation. These fans run only at the speed of the crankshaft, i.e. the engine speed. Consequently, the fan does not run fast enough when the engine needs the most cooling during idle, slow speeds, and other times.

Moreover, these fans cannot be disengaged from the crankshaft when the engine does not need the fan. For example, an engine does not need the fan to operate during engine warm-up. An operating fan would extend the warm-up period and take energy from the engine. Similarly, an engine does not need the fan to operate when the truck or motor vehicle is moving at higher speeds. The airflow at higher speeds is sufficient to cool the engine. In addition, an operating fan becomes a drag on the engine, reducing engine performance and lowering fuel efficiency.

Finally, a typical crankshaft-mounted fan prohibits power takeoff from the front of the engine. With the fan blocking the crankshaft, it is impossible to connect a power takeoff device to the crankshaft. Consequently, these fans limit the use of power takeoff devices to the rear of the truck or vehicle.

Accordingly, there is a need for a crankshaft-mounted cooling fan that operates faster than the engine speed, can be turned on/off when needed, and has power takeoff capability through the crankshaft.

SUMMARY OF THE INVENTION

The present invention provides a clutched, speed-rated, crankshaft-mounted cooling fan with full drive through capability. The cooling fan has an adapter mounted on the engine's crankshaft. The adapter extends beyond the engine's front cover and is capable of being coupled to a power takeoff device (PTO). A PTO is not required to operate the fan, thus permitting the PTO to be added at a later date. The PTO may be coupled to the adapter inside or outside of the engine cavity.

The adapter is operatively connected to first and second adapter bearings, which in turn are operatively connected to a planetary gear assembly. The planetary gear assembly has a drive gear, one or more planet assemblies, and a fan gear.

The drive gear has a gear portion and plate extension. The gear portion of the drive gear engages one or more planet assemblies. The fan gear has a gear section and a fan extension for coupling with a fan blade set.

Each planet assembly has a planet bolt for coupling a power transfer gear coupled to a fan drive gear. The power transfer gear engages the drive gear at its gear portion. The fan drive gear engages the fan gear at its gear section.

The planet assembly is operatively connected to a fan housing. The planet bolt is positioned within a planet bearing, which is located inside a cavity formed by a planet support on the housing. In addition, a fan bearing is operatively connected to the housing and the fan extension. The fan housing connects to the engine.

A clutch assembly is attached to the adapter in a position where a clutch plate may engage the plate extension of the drive gear. A solenoid is connected to the fan housing and is disposed for activating the clutch assembly.

In operation, the adapter is rotating at the engine speed. When the clutch assembly is activated, the clutch plate engages the plate extension on the drive gear. The drive gear rotates the power transfer gear, which in turn rotates the fan drive gear. The fan drive gear rotates the fan gear, which in turn rotates the fan blade set.

The gear ratios of the planetary gear assembly are chosen so the fan blade set rotates at a faster speed than the engine. Fan ratios of 1.2 or 1.3 are suitable for most internal combustion engines. The clutch assembly may be activated or deactivated depending on the operating parameters of the engine or a motor vehicle. For example, the clutch may be activated when the engine temperature rises above a particular temperature. The clutch may be deactivated when the vehicle goes faster than a certain speed. A microprocessor may be used to control the clutch assembly.

The following drawings and description set forth additional advantages and benefits of the invention. More advantages and benefits are obvious from the description and may be learned by practice of the invention.

BRIEF DESCRIPTION OF THE DRAWINGS

The present invention may be better understood when read in connection with the accompanying drawings, of which.

DETAILED DESCRIPTION OF THE INVENTION

Figure 1:
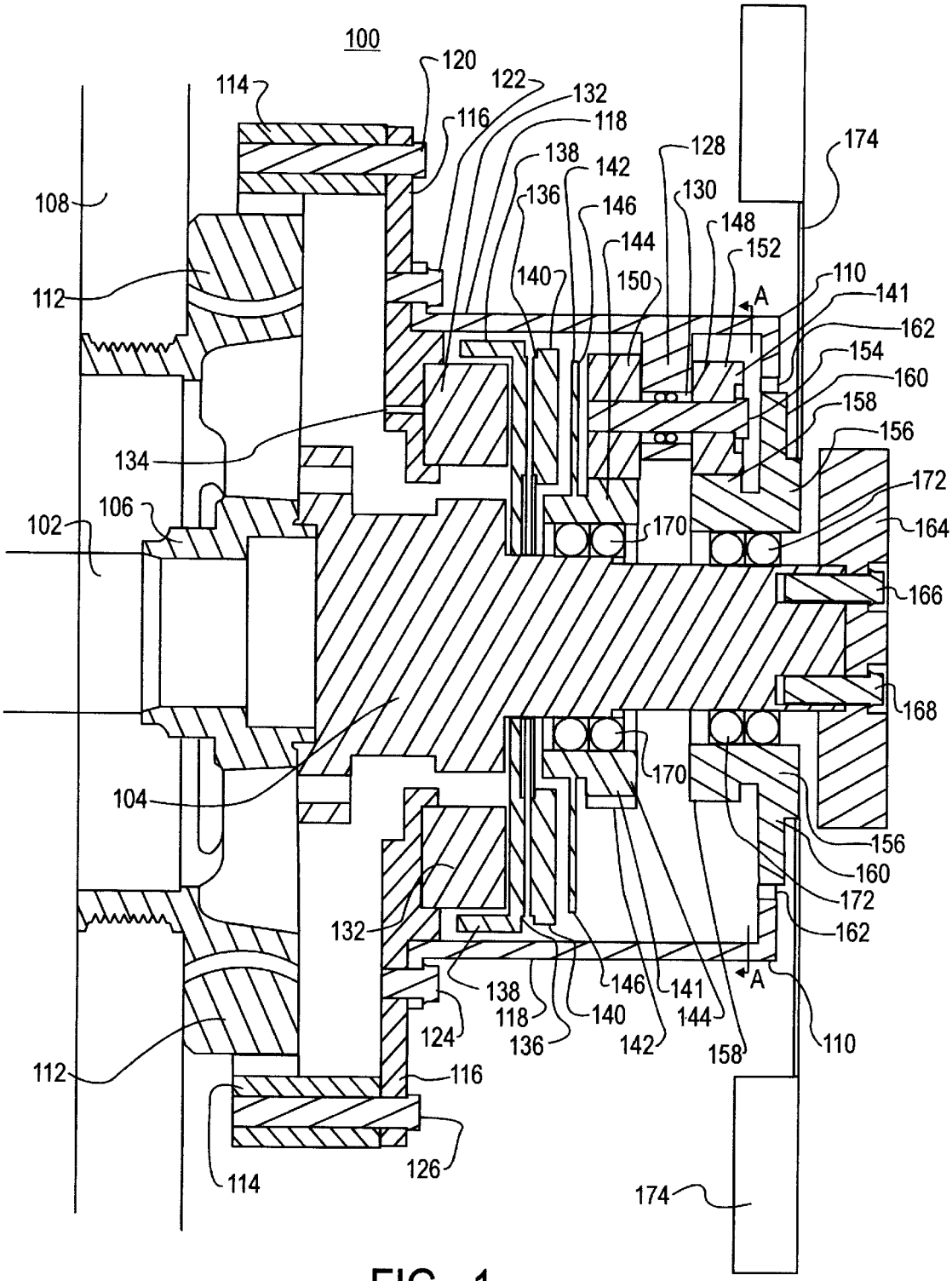
FIG. 1 is a cross-sectional side view of a crankshaft-mounted fan with a power takeoff device according to the present invention.

FIG. 1 shows the crankshaft-mounted fan 100 of the present invention. The crankshaft-mounted fan 100 includes an adapter 104, a clutch assembly 136, and a planetary gear assembly 141 within a fan housing 110. The adapter 104 is capable of connecting to a power takeoff device 164. The planetary gear assembly connects to a fan blade set 174.

The adapter 104 connects to a crankshaft 102 via a damper 106. The crankshaft is operatively positioned within an engine (not shown). The adapter 104 extends beyond a front cover 108 of the engine to form an extension of the crankshaft 102. Preferably, the adapter 104 is made of cast or forged steel. However, it may be made from other materials or a combination suitable to withstand the torsional and other forces during operation of the fan. The adapter 104 is operatively connected to a first adapter bearing 170 and a second adapter bearing 172. During operation of the engine, the adapter 104 rotates essentially at the same speed and in the same direction as the crankshaft 102. The adapter 104 also rotates freely against the first adapter bearing 170 and the second adapter bearing 172.

The clutch assembly 136 is attached to the adapter 104 and includes a flywheel 138 and a clutch plate 140. Preferably, the clutch assembly 136 is made of cast or forged steel. However, it may be made from other materials or a combination suitable to withstand the torsional, frictional, and other forces during operation of the fan. When the engine is running, the clutch assembly 136 rotates essentially at the same speed and in the same direction as the adapter 104.

The power takeoff device (PTO) 164 may be connected to the adapter 104 using bolts 166, 168. Other methods may be used to connect adapter 104 and PTO such as a lock pin (not shown) or a coupling (not shown). PTO 164 is not required for operation of the crankshaft-mounted fan 100.

Figure 2:
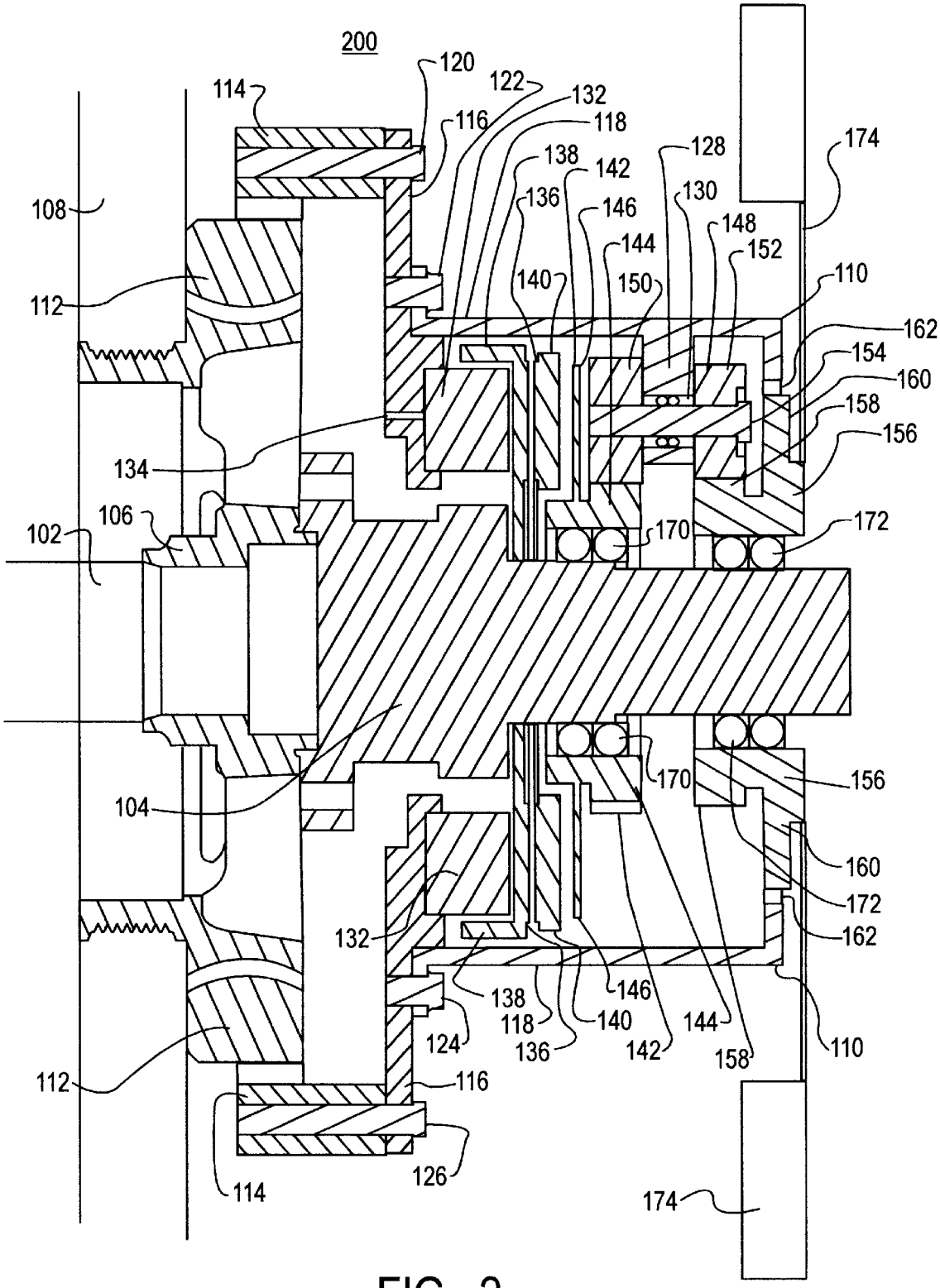
FIG. 2 is a cross-sectional side view of a crankshaft-mounted fan without a power takeoff device according to the present invention.

FIG. 2 shows a crankshaft-mounted fan 200 of the present invention without a power takeoff device. PTO 164 may be included when the engine is built or it may be added at a later date. PTO 164 may be any power takeoff device capable of using or of being adapted to use the direct drive from the engine. If space is available, PTO 164 may be mounted in the engine cavity as shown in FIG. 1. If no space is available, PTO 164 may be mounted outside the engine cavity (not shown). In which case, the adapter 104 would extend to PTO 164 (for example, directly through the radiator). Conversely, the adapter 104 could connect indirectly to PTO 164 using gears, belts and pulleys, or similar means (not shown).

In FIG. 1, the fan housing 110 includes a base housing 112, a solenoid support housing 116, and a gear housing 118. Preferably, the fan housing 110 is made of cast iron or steel. The housing may be made from other materials or a combination. The base housing 112 is coupled to the front cover 108 of the engine. The base housing 112 forms a base extension 114 for connecting to the solenoid support housing 116 using bolts 120, 126 and other bolts not shown. The gear housing 118 connects to the solenoid support housing 116 using bolts 122, 124 and other bolts not shown. While bolts are preferred for connecting the housings, other connection methods may be used such as rivets and welding. Even though the housings are shown as separate pieces, the housings could be a single piece, different multiple pieces, or different configurations.

Figure 3:
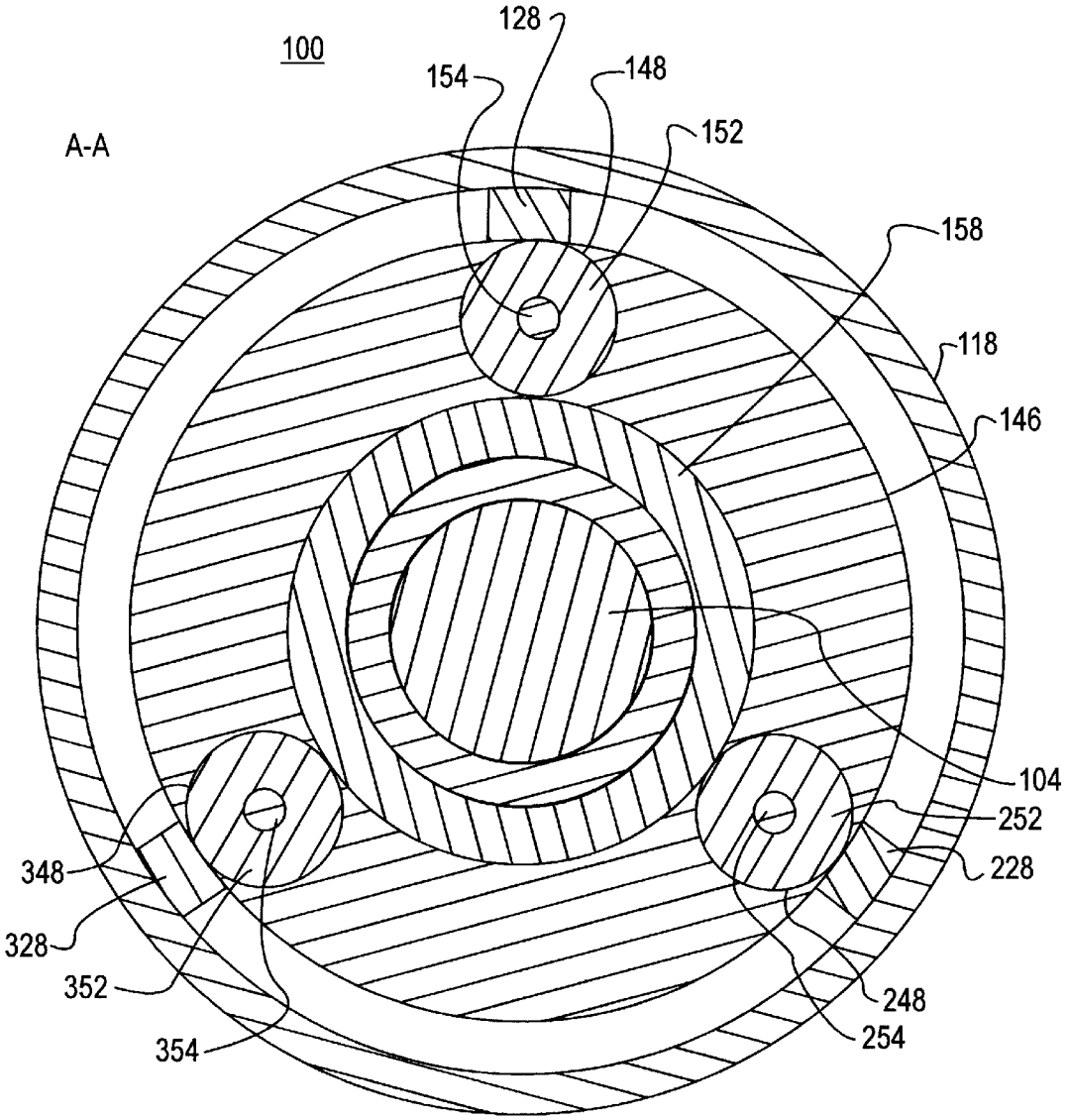
FIG. 3 is a cross-sectional front view of section A—A of the crankshaft-mounted fan in FIG. 1.

The gear housing 118 forms a first planet support 128, which has a cavity for holding the first planet bearing 130. The gear housing 118 also forms a second planet support 228 and a third planet support 328 as seen in FIG. 3. Preferably, the second and third planet supports 228, 328 are the same as planet support 128. However, they could have different sizes and shapes. As with the first planet support 128, the second and third planet supports 228, 328 have cavities for holding second and third planet bearings (not shown).

The planetary gear assembly 141 has a drive gear 142, a fan gear 156, and three planet assemblies. Preferably, the planetary gear assembly 141 is made of cast or forged steel. However, it may be made from other materials, or a combination. The planet assemblies are substantially identical to each other. One planet assembly is mounted in each of the planet supports 128, 228, 328 formed on the gear housing 118. The first planet assembly 148 is described in detail. The second and the third planet assemblies are not described in detail because it is understood they have essentially the same structure, components, and interactions with other parts as the first planet assembly 148.

A first planet assembly 148 includes a first power transfer gear 150, a first fan drive gear 152, and a first planet bolt 154. The first planet bolt 154 is positioned inside the first planet bearing 130 for connecting the first power transfer gear 150 and the first fan drive gear 152 on opposite sides of the first planet support 128. Once assembled on the first planet support 128, the first planet assembly 148 rotates freely inside the first planet bearing 130.

The first power transfer gear 150 engages the gear portion 144 of the drive gear 142, which has a plate extension 146. Drive gear 142 is positioned operatively between the first power transfer gear 150 and the first adapter bearing 170 located on the adapter 104. The gear portion 144 engages the first power transfer gear 150. The plate extension 146 is positioned for contact with the clutch plate 140 when clutch assembly 136 is activated.

A solenoid 132 is mounted on the solenoid support housing 116. The solenoid 132 is located adjacent to but not touching the clutch assembly 136 for engaging and disengaging the clutch plate 140. A control wire 134 provides electrical power to the solenoid 132 for engaging and disengaging the clutch plate 140. While an electrical clutch is preferred, other clutches may be used such as a viscous or pneumatic type.

Preferably, a microprocessor (not shown) is used to control the operation of clutch assembly 136. Any type of microprocessor may be used that is suitable for use in a motor vehicle and is capable of performing the control features. In place of a microprocessor, a logic circuit or other electrical circuitry may be used.

The microprocessor engages and disengages the clutch plate 140 and the plate extension 146 based on operating parameters of the engine and the motor vehicle. For example, the microprocessor engages the clutch plate 140 when temperature sensors indicate the engine temperature has risen above a predetermined temperature. The temperature sensors may measure the temperature of the cooling fluid, the temperature of the oil, or other temperatures to ascertain the engine temperature. In another example, the microprocessor disengages the clutch plate 140 when sensors indicate the speed of the motor vehicle is faster than a predetermined speed.

The first fan drive gear 152 engages the fan gear 156, which has a gear section 158 and a fan extension 160. Fan gear 156 is positioned operatively between the first fan drive gear 152 and the second adapter bearing 172 located on adapter 104. The gear section 158 engages the first fan drive gear 152. Fan extension 160 is operatively connected to fan bearing 162 located on gear housing 118. The fan bearing may be a gasket or other suitable material to buffer the gearing housing 118 from operation of the fan gear 156. The fan extension 160 is coupled to the fan blade set 174.

The fan blade set 174 may be any fan suitable for use in an engine. Preferably, the fan blade set 174 is made of plastic or other polymer. However, the fan blade set 174 may be made from other materials or a combination. The fan blade set 174 may include one or more arms and blades as illustrated in FIGS. 1 and 2. It may include a support ring (not shown) for snap fitting or otherwise connecting the fan blade set 174 to the fan extension 160. Such support ring may include or otherwise take the place of the fan bearing 162.

FIG. 3 shows a front, cross-sectional view of the crankshaft-mounted fan 100 according to the present invention. The gear housing 118 forms the first planet support 128, the second planet support 228, and the third planet support 338.

The first planet assembly 148 is connected to the first planet support 128. The first planet bolt 154 connects the first fan drive gear 152 to the first power transfer gear 150 (hidden). The first planet bolt 154 is positioned inside the first planet bearing 130 (hidden) located in a cavity formed by planet support 128. The first power transfer gear 150 (hidden) engages the gear portion 144 (hidden) of the drive gear 142.

Similarly, the second planet assembly 248 is connected to the second planet support 228. The second planet bolt 254 connects the second fan drive gear 252 to the second power transfer gear (hidden). The second planet bolt 254 is positioned inside the second planet bearing (hidden) located in a cavity formed by planet support 228. The second power transfer gear (hidden) engages the gear portion 144 (hidden) of the drive gear 142.

Likewise, the third planet assembly 348 is connected to the third planet support 328. The third planet bolt 354 connects the third fan drive gear 352 to the third power transfer gear (hidden). The third planet bolt 354 is positioned inside the third planet bearing (hidden) located in a cavity formed by planet support 328.

The first, second, and third power transfer gears (hidden) engage the gear portion 144 (hidden) of the drive gear 142. The plate extension 146 of the drive gear 142 is positioned to engage the clutch plate 140 (hidden).

The first, second, and third fan drive gears 152, 252, 352 engage the gear section 158 of the fan gear 156. The gear section 158 is operatively positioned between the first fan drive gear 152 and the second adapter bearing 172 for the fan gear 156 to rotate around the adapter 104.

In the preferred embodiment, the planetary gear assembly 141 includes three planet assemblies 152, 252, 353 having an equal distance—120° from each other—around the adapter. However, one or other multiples of planet assemblies may be used. The planet assemblies may be unequal distances from each other. Other planetary gear arrangements may also be used.

In operation, clutch assembly 136 is activated to rotate the fan blade set 174. The clutch plate 140 engages plate extension 146 to rotate the planetary gear assembly 141, which in turn rotates the fan blade set 174.

Conversely, clutch assembly 136 is deactivated to stop rotating the fan blade set 174. The clutch plate 140 disengages from plate extension 146 to stop rotating the planetary gear assembly 141, which in turn stops rotating the fan blade set 174.

When the clutch assembly 136 is deactivated, the fan blade set 174 may not stop turning completely. Inertia may keep the fan blade set 174 turning. While the truck or vehicle is moving, the airflow through the engine cavity may rotate fan blade set 174.

Clutch assembly 136 may be activated and deactivated at any time depending on the operation of the engine or motor vehicle. For example, the clutch assembly 136 may be activated once the engine is warmed-up and deactivated once the truck or vehicle exceeds a particular speed. In addition, the clutch assembly 136 may be activated or deactivated depending on operating parameters of the engine. For example, temperature sensors (not shown) in the oil reservoir or radiator may activate or deactivate the clutch assembly 136 based on the temperature of the oil or cooling fluid. Other sensors may deactivate the clutch assembly 136 when the motor vehicle exceeds a particular speed.

To activate the electrical clutch of the illustrated embodiment, an electrical signal on the control wire 134 energizes the solenoid 132. The energized solenoid 132 forces the clutch plate 140 to engage the plate extension 146 of the drive gear 142. A pneumatic or viscous clutch assembly would operate differently.

When the clutch plate 140 is engaged, the drive gear 142 rotates essentially at the same speed as the adapter 104 (i.e. the engine speed). Drive gear 142 rotates the power transfer gears on the planet assemblies, which rotate the fan drive gear via the planet bolts. The fan drive gears rotate the fan gear 156, which rotates the fan blade set 174.

In the preferred embodiment, the crankshaft-mounted fan 100 has a fan ratio designed for the airflow needs of the particular engine on which the fan is used. In most applications, the fan must to run faster than the engine speed when clutch assembly 136 is engaged. Generally, fan ratios of 1.2 and 1.3 are sufficient for most internal combustion engines. These fan ratios mean the fan blade set 174 spins 20 or 30 percent faster, respectively, than the engine speed when the clutch plate 140 is engaged. Alternate gear sizes and arrangements may be chosen to obtain a desired fan ratio. Other fan ratios may be used to obtain different fan speeds even a fan speed slower than the engine speed (i.e. a fan ration less than 1).

To achieve a fan ratio of 1.2 in the illustrated embodiment, the drive gear 124 has 56 teeth (not shown). Each of the power transfer gears has 20 teeth (not shown). Each of the fan drive gears has 25 teeth (not shown). The fan gear 140 has 58 teeth (not shown). The gears may have different combinations of gear teeth and yet have a fan ration of 1.2.

While the invention has been described and illustrated, this description is by way of example only. Additional advantages will readily occur to those skilled in the art, who may make numerous changes without departing from the true spirit and scope of the invention.

Therefore, the invention is not limited to the specific details, representative devices, and illustrated examples in this description. Accordingly, the scope of the invention is to be limited only as necessitated by the accompanying claims.

What is claimed is:

1. A cooling fan for mounting on a crankshaft of an internal combustion engine, the cooling fan comprising:

an adapter configured for mounting on the crankshaft, the adapter capable of coupling with a power takeoff device;

at least one bearing operatively connected to the adapter;

a planetary gear assembly operatively connected to the at least one bearing;

a clutch assembly attached to the adapter, the clutch assembly disposed to engage the planetary gear assembly; and at least one fan blade coupled to the planetary gear assembly.

2. A cooling fan according to claim 1, wherein the planetary gear assembly rotates the at least one fan blade at a speed faster than the engine speed when the clutch assembly engages the planetary gear assembly.

3. A cooling fan according to claim 1 wherein the planetary gear assembly comprises:

a drive gear having a plate extension for engaging with the clutch assembly;

at least one planet assembly including, a power transfer gear operatively engaged to the drive gear;

a fan drive gear coupled to the power transfer gear; and a fan gear operatively engaged to the fan drive gear, the fan gear having a fan extension for coupling with the at least one fan blade.

4. A cooling fan according to claim 3, wherein the at least one planet assembly includes a first planet assembly, a second planet assembly, and a third planet assembly.

5. A cooling fan according to claim 4, wherein the planet assemblies are positioned equally around the adapter.

6. A cooling fan according to claim 3, wherein the at least one bearing includes a first adapter bearing and a second adapter bearing;

wherein the drive gear is operatively connected to the first adapter bearing; and wherein the fan gear is operatively connected to the second adapter bearing.

7. A cooling fan according to claim 1 further comprising a power takeoff device coupled to the adapter.

8. A cooling fan according to claim 1 further comprising a housing connected to the planetary gear assembly.

9. A crankshaft-mounted cooling fan for an internal combustion engine, the cooling fan comprising:

an adapter mounted on a crankshaft, the adapter capable of coupling with a power takeoff device, the crankshaft operatively positioned within the engine;

a housing connected to the engine, the housing disposed adjacent to the adapter;

a planetary gear assembly operatively connected to the housing;

a clutch assembly attached to the adapter, the clutch assembly positioned to engage the planetary gear assembly; and at least one fan blade coupled to the planetary gear assembly.

10. A crankshaft-mounted cooling fan according to claim 9, wherein the planetary gear assembly rotates the at least one fan blade at a speed faster than the engine speed when the clutch assembly engages the planetary gear assembly.

11. A crankshaft-mounted cooling fan according to claim 9 further comprising at least one bearing operatively connected to the adapter, wherein the planetary gear assembly is operatively connected to the at least one bearing.

12. A crankshaft-mounted cooling fan according to claim 11, wherein the at least one bearing includes, a first adapter bearing operatively connected to the adapter, a second adapter bearing operatively connected to the adapter; and wherein the planetary gear assembly includes, a drive gear having a plate extension for engaging with the clutch assembly, the drive gear operatively connected to first adapter bearing;

at least one planet assembly including, a power transfer gear operatively engaged to the drive gear;

a fan drive gear coupled to the power transfer gear; and a fan gear operatively engaged to the fan drive gear, the fan gear operatively connected to the second adapter bearing, the fan gear having a fan extension for coupling with the at least one fan blade.

13. A crankshaft-mounted cooling fan according to claim 12, wherein the housing has at least one planet support forming a cavity; and wherein the at least one planet assembly further includes a planet bolt for coupling the power transfer gear to the fan drive gear, the planet bolt operatively connected to a planet bearing, the planet bearing operatively disposed within the cavity.

14. A crankshaft-mounted cooling fan according to claim 12 further comprising a fan bearing operatively connecting the housing and the fan gear.

15. A crankshaft-mounted cooling fan according to claim 14, wherein the at least one fan blade forms the fan bearing.

16. A crankshaft-mounted cooling fan according to claim 12, wherein the at least one planet assembly includes a first planet assembly, a second planet assembly, and a third planet assembly.

17. A crankshaft-mounted cooling fan according to claim 16, wherein the planet assemblies are positioned equally around the adapter.

18. A crankshaft-mounted cooling fan according to claim 9, wherein the clutch assembly is an electrical clutch, and wherein the cooling fan further comprises a solenoid attached to the housing, the solenoid disposed adjacent to the clutch assembly for activating a clutch plate to engage the planetary gear assembly.

19. A crankshaft-mounted cooling fan according to claim 9, further comprising:

a power takeoff device coupled to the adapter.

20. A crankshaft-mounted cooling fan according to claim 9, further comprising a microprocessor for controlling the clutch assembly based on at least one operating parameter of the engine.

21. An internal combustion engine having a crankshaft-mounted cooling fan, the engine comprising:

an engine block;

a crankshaft operatively positioned inside the engine block;

an adapter connected to the crankshaft, the adapter capable of coupling with a power takeoff device;

a first adapter bearing operatively connected to the adapter;

a second adapter bearing operatively connected to the adapter;

a housing connected to the engine block, the housing disposed adjacent to the adapter;

a planetary gear assembly operatively connected to the housing, wherein the planetary gear assembly includes, a drive gear having a plate extension for engaging with the clutch assembly, the first drive gear operatively connected to the first adapter bearing, at least one planet assembly including, a power transfer gear operatively engaged to the drive gear;

a fan drive gear coupled to the power transfer gear; and a fan gear operatively engaged to the fan drive gear, the fan gear operatively connected to the second adapter bearing the fan gear having a fan extension for coupling with the at least one fan blade;

a clutch assembly attached to the adapter, the clutch assembly positioned to engage the planetary gear assembly; and a cooling fan coupled to the planetary gear assembly, wherein the planetary gear assembly rotates the cooling fan at a speed faster than the engine speed when the clutch assembly engages the planetary gear assembly.

22. A internal combustion engine according to claim 21, wherein the at least one planet assembly includes a first planet assembly, a second planet assembly, and a third planet assembly, wherein the planet assemblies are positioned equally around the adapter.

23. A internal combustion engine according to claim 21, the engine further comprising a power takeoff device coupled to the adapter.

24. A internal combustion engine according to claim 23, wherein the adapter couples to the power takeoff device inside an engine cavity of a motor vehicle.

25. A internal combustion engine according to claim 23, wherein the adapter extends for coupling to the power takeoff device outside an engine cavity of a motor vehicle.

26. An internal combustion engine according to claim 21, further comprising a microprocessor for controlling the clutch assembly based on at least one operating parameter of the engine.

27. An internal combustion engine according to claim 26, wherein the at least one operating parameter is the engine temperature.

28. An internal combustion engine according to claim 21, wherein the engine is part of a motor vehicle; and wherein the microprocessor controls the clutch assembly based on at least one operating parameter of the motor vehicle.

29. An internal combustion engine according to claim 28, wherein the at least one operating parameter is the speed of the vehicle.

* * * * *